US005164106A

United States Patent [19]

Ahmed et al.

[11] Patent Number: 5,164,106

[45] Date of Patent: Nov. 17, 1992

[54] NONAQUEOUS LIQUID AUTOMATIC DISHWASHER DETERGENT COMPOSITION CONTAINING A DUAL BLEACH SYSTEM

[75] Inventors: Fahim U. Ahmed, Dayton; Kathleen Bochis, East Brunswick, both of N.J.

[73] Assignee: Colgate-Palmolive Company, Piscataway, N.J.

[21] Appl. No.: 688,775

[22] Filed: Jul. 15, 1991

Related U.S. Application Data

[63] Continuation of Ser. No. 419,242, Oct. 10, 1989, abandoned, which is a continuation-in-part of Ser. No. 344,732, Apr. 28, 1989, abandoned.

[51] Int. Cl.[5] ..... C11D 7/04; C11D 7/50; C11D 7/54; C11D 7/56

[52] U.S. Cl. ..... 252/104; 252/99; 252/139; 252/186.35; 252/187.25; 252/187.27; 134/25.2

[58] Field of Search ..... 252/95, 99, 104, 135, 252/139, 186.35, 187.2, 187.24, 187.25, 187.26, DIG. 10, DIG. 14; 134/25.2

[56] References Cited

U.S. PATENT DOCUMENTS

| | | | |
|---|---|---|---|
| 3,519,569 | 7/1970 | Diez | 252/99 |
| 4,102,799 | 7/1978 | Fink et al. | 252/99 |
| 4,753,748 | 6/1983 | Laitem et al. | 252/99 |
| 4,755,354 | 7/1988 | Trinh et al. | 422/37 |
| 4,789,496 | 12/1988 | Broze et al. | 252/99 |
| 5,076,952 | 12/1991 | Ahmed et al. | 252/95 |

FOREIGN PATENT DOCUMENTS 0186234 7/1986 European Pat. Off. .

*Primary Examiner*—A. Lionel Clingman
*Assistant Examiner*—Erin M. Higgins
*Attorney, Agent, or Firm*—Richard E. Nanfeldt; Robert C. Sullivan; Murray Grill

[57] ABSTRACT

The application is directed to a nonaqueous liquid automatic dishwasher detergent composition containing a dual bleach system. The composition contains a nonaqueous organic carrier liquid, a chlorine bleach source and a bromide compound. In the wash bath the chlorine source reacts with water to form hypochlorite and the bromide compound reacts with a portion of the hypochlorite to form hypobromite. The active ingredients of the dual bleach system are the hypochlorite and hypobromite which provide improved cleaning performance against both proteinaceous and starchy carbohydrate soils. The dishwashing compositions comprise a nonaqueous organic carrier liquid, a surfactant, a chlorine bleach source and a bromide compound, are stable in storage and are readily dispersible in water.

25 Claims, No Drawings

NONAQUEOUS LIQUID AUTOMATIC DISHWASHER DETERGENT COMPOSITION CONTAINING A DUAL BLEACH SYSTEM

RELATED APPLICATION

The present application is a continuation of applicants' related application U.S. Ser. No. 07/419,242, filed Oct. 10, 1989, now abandoned which in turn is a continuation in part of applicants' [copending] relating application U.S. Ser. No. 07/344,732, filed Apr. 28, 1989, now abandoned.

FIELD OF THE INVENTION

The present invention relates to a nonaqueous liquid automatic dishwasher detergent composition having improved cleaning performance against difficult to remove soils. The present invention is more particularly directed to a stable nonaqueous liquid composition containing a dual bleach system for use in an automatic dishwasher to clean dishware, glassware, cookware and the like.

The dishwashing compositions are concentrated and comprise an organic carrier liquid, a surfactant and a stable suspension of a builder salt. The detergent compositions of the present invention are stable in storage and are readily pourable.

The present invention relates to an improved nonaqueous liquid dual bleach composition and to a method of making and using the composition.

BRIEF DESCRIPTION OF THE INVENTION

The present invention is directed to a nonaqueous liquid automatic dishwasher detergent composition having improved cleaning performance for proteinaceous and carbohydrate soils. The liquid detergent composition contains a chlorine bleach source and a bromide source. The detergent composition more particularly contains a source of hypochlorite ion and a source of bromide ion.

When the detergent composition is added to a wash bath a portion of the hypochlorite ion reacts in situ with the bromide ion to form hypobromite ion which is a powerful oxidizing agent.

The newly formed hypobromite ion is an effective agent for cleaning carbohydrate soils and the remaining unreacted hypochlorite ion is an effective agent for cleaning proteinaceous soils.

The present invention specifically relates to liquid automatic dishwashing detergent concentrate compositions having improved cleaning performance against proteinaceous and starchy carbohydrate soils on dishware, glassware, cookware and the like, particularly cooked on and baked on soils.

The nonaqueous liquid compositions are stable in storage, do not settle, are pourable and are readily dispersed in water.

PRIOR ART

Commercially available houshold-machine dishwasher detergents provided in powder or liquid form have the disadvantage of not being effective in cleaning both proteinaceous and starchy carbohydrate soils. The cooked on and baked on proteinaceous and starchy carbohydrate soils are particularly hard to remove. Though some detergent compositions have been found to be effective in removing proteinaceous soils and others have been found effective in removing starchy carbohydrate soils, none have been found effective in removing both proteinaceous and starchy carbohydrate soils from dishware, glassware, cookware and the like.

For effective use, it is generally recommended that the automatic dishwashing detergent, hereinafter also designated ADD, contain (1) sodium tripolyphosphate (NaTPP) to soften or tie up hard-water minerals and to emulsify and/or peptize soil; (2) sodium silicate to supply the alkalinity necessary for effective detergency and to provide protection for dishware, such as fine china and protection against machine corrosion; (3) sodium carbonate, generally considered to be optional, to enhance alkalinity; (4) a chlorine-releasing agent to aid in cleaning; (5) a surfactant and (6) a defoamer to reduce foam, thereby enhancing machine efficiency. See, for example, SDA Detergents in Depth, "Formulations Aspects Of Machine Dishwashing," Thomas Oberle (1974). Cleansers approximating to the afore-described compositions are mostly liquids or powders. Generally, such compositions omit hypochlorite bleach, since it tends to react with other chemically active ingredients, particularly surfactant, thereby impairing its effectiveness.

The most difficult food soils to remove from dishware, cookware and utensils are proteinaceous and starchy carbohydrate soils. The proteinaceous soils can be in the form of baked on or cooked on milk, meats and egg soils. The starchy carbohydrate soils can be in the form of baked on or cooked on starchy carbohydrates such as pasta, oatmeal, porridge, bread, cake and the like.

These two types of food soils are very tenaciously bound to the dishware, cookware and utensil substrates and are very difficult to clean without scrubbing.

Proteinaceous materials, for example, egg protein can be removed by appropriate concentrations of, for example, sodium hypochlorite bleach. However, dishwasher detergent compositions containing hypochlorite ion perform poorly on starchy carbohydrate soils.

The hypobromite ion is a strong oxidizing agent, but is so reactive that it is chemically unstable in aqueous detergent compositions. Bromide ion when contacted with hypochlorite in an aqueous alkaline medium wash bath reacts to form hypobromite. The hypobromite effectively degrades starchy carbohydrates.

However, if too much bromide ion is present in the wash bath, it will substantially reduce the hypochlorite ion concentration and/or will completely remove the hypochlorite from the wash bath and the proteinaceous soils are not removed.

If an insufficient amount of bromide ion is present the starchy carbohydrate soils are not removed.

The problem to be solved was to formulate a nonaqueous liquid dishwasher detergent composition that was stable in storage and was effective in a wash bath in removing both proteinaceous and starchy carbohydrate soils.

In the Diez U.S. Pat. No. 3,519,569 there is disclosed an abrasive scouring cleaner containing as essential ingredients a water insoluble siliceous abrasive material, a hypochlorite-chlorine liberating compound, a water soluble detergent compound and an alkali metal bromide.

The Finck U.S. Pat. No. 4,102,799 discloses an alkaline automatic dishwasher detergent composition which is essentially free of inorganic phosphates and which consists essentially of a citrate compound, and one or more inorganic builder salts such as silicates, carbonates and/or sulfate. The composition can also contain one or more bleaching agents which are capable of liberating hypochlorite chlorine and/or hypobromite bromine on contact with aqueous media.

The Hartman European Patent Application No. 0,186,234 dicloses an automatic dishwasher powder detergent composition comprising a detergent builder, a source of hypochlorite, a low-sudsing nonionic surfactant, an anti-sudsing agent and an alkali metal or alkaline earth metal bromide.

The Laitem et al U.S. Pat. No. 4,753,748 discloses a nonaqueous liquid automatic dishwashing detergent composition comprising a liquid nonionic surfactant containing a stable or readily redispersible suspension of a polyphosphate builder and/or citrate salt and an alkylene glycol mono alkyl ether anti-gel agent.

ADVANTAGES OVER THE PRIOR ART

The nonaqueous liquid detergent compositions of the present invention overcome many of the prior art problems. Because of the addition of a small effective amount of a bromide to the compositions, which generates hypobromite in the wash bath the composition can be used to remove both proteinaceous and starchy carbohydrate soils from dishware, glassware, cookware and the like.

In accordance with the present invention a stable nonaqueous liquid dishwashing detergent composition containing a balanced source of hypochlorite ion and hypobromite ion is advantageously provided such that the composition efficiently and effectively cleans both proteinaceous and starchy carbohydrate soils from dishware, glassware, cookware and utensils in an automatic dishwashing machine.

The nonaqueous liquid automatic dishwashing detergent compositions of the present invention have the advantages of being stable, nonsettling in storage, and non-gelling in storage, and are readily dispersible in the dishwashing machine. The liquid compositions of the present invention are easily pourable, easily measured and easily put into dishwashing machines and are readily soluble in the wash water in the dishwashing machines.

Further, because the dishwashing machines as built and marketed have a built in volume space in which the detergent is placed, the highly concentrated nature of the liquid detergent concentrate composition of the present invention allows placing in the dishwashing machine more active liquid nonionic surfactant detergent and more dispersed polyphosphate and other detergent builders.

OBJECTS OF THE PRESENT INVENTION

It is an object of the present invention to provide a nonaqueous liquid automatic dishwasher detergent composition that has improved cleaning performance against difficult to remove proteinaceous and starchy carbohydrate soils.

It is another object of the invention to provide a nonaqueous liquid detergent concentrate composition which is stable in storage, does not degrade or decompose, is easily pourable, is readily dispersible and is readily soluble in the dishwashing water.

Another object of the present invention is to prepare a nonaqueous automatic dishwasher detergent composition which contains both a chlorine bleach source and a bromide source.

Another object of the present invention is to prepare a nonaqueous liquid automatic dishwasher detergent composition which on addition to a wash bath generates a balanced amount of hypochlorite ions and hypobromite ions, which are strong oxidizing agents and together are effective in cleaning both proteinaceous and starchy carbohydrate soils.

A further object of the invention is to provide a method for washing dishware, glassware, cookware and the like in an automatic dishwashing machine using a nonaqueous liquid dual bleach system detergent composition which is effective in removing both proteinaceous and starchy carbohydrate soils.

A still further object of the invention is to provide a method of washing dishware, glassware, cookware and the like in an automatic washing machine using a nonaqueous liquid nonionic surfactant detergent composition by which method both proteinaceous and starchy carbohydrate soils are efficiently and effectively removed from dishware, glassware, cookware, and the like.

It is a further object of this invention to provide stable nonaqueous liquid detergent dual bleach compositions, especially automatic dishwasher detergent compositions, by incorporating in the composition a source of chlorine bleach and a small effective amount of bromide compound.

DETAILED DESCRIPTION OF THE INVENTION

These and other objects of the invention which will become more readily understood from the following detailed description of the invention and preferred embodiments thereof are achieved by incorporating in the nonaqueous liquid detergent composition a source of chlorine bleach and a small but effective amount of bromide as the dual bleach system.

In accordance with the present invention there is provided a nonaqueous liquid automatic dishwasher detergent composition which includes, on a weight basis;

(a) 20 to 60% carrier liquid;
(b) 0.1 to 12% chlorine bleach stable, water dispersible organic surfactant detergent active material;
(c) 20 to 60% organic or inorganic builder salt;
(d) 5 to 30% sodium silicate;
(e) chlorine bleach compound in an amount to provide 0.5 to 10% available chlorine;
(f) 0.1 to 6.0% bromide compound;
(g) 0 to 25% alkali metal carbonate; and
(h) 0 to 6% chlorine bleach stable foam depressant.

The mole ratio of the bromide to available chlorine is critical and is 0.04 to 0.12.

The present invention also provides a method for cleaning dishware, glassware and cookware in an automatic dishwashing machine with an aqueous wash bath containing an effective amount of the automatic dishwasher detergent (ADD) nonaqueous liquid composition as described above. According to this aspect of the invention, the ADD composition is stable in storage, is easily measured and can be readily poured into the automatic dishwashing machine.

The invention will now be described in greater detail by way of specific embodiments thereof.

In accordance with the present invention an improved automatic dishwasher detergent composition is prepared by incorporating small amounts of a bromide containing compound in a nonaqueous liquid dishwasher composition containing an organic carrier liquid, a surfactant and a source of hypochlorite ion. When the dishwasher detergent composition is added to an aqueous wash bath the bromide reacts with a portion of the hypochlorite and the bromide is converted to hypobromite, a strong oxidizing agent.

The present invention is based upon the discovery that substantially improved cleaning performance for both proteinaceous and starchy carbohydrate soils can be obtained by adding to a nonaqueous liquid detergent composition a source of hypochlorite and a small effective amount of a bromide compound which when the detergent composition is added to the aqueous wash bath form a hypochlorite and hypobromite dual bleach system.

In accordance with an embodiment the present invention a nonaqueous liquid automatic dishwashing detergent concentrate composition is prepared by dispersing a polyphosphate builder in an organic carrier liquid. The polyphosphate builder may be replaced in whole or in part by organic detergent builders such as alkali metal citrates or tartrates.

In addition other ingredients can be added to the composition such as anti-encrustation agents, anti-foam agents, optical brighteners, enzymes and perfume.

Organic Carrier Liquids

The organic carrier liquids that can be used in accordance with the present invention are the carrier liquids, diluents and solvents that are conventionally used in formulating dishwasher detergents compositions. Suitable organic carrier liquids are propylene glycol, propylene carbonate, polypropylene glycol M.W. 200, polypropylene glycol M.W. 300, methoxy propylene glycol, Carbwax MPEG 350 (polyethylene glycol methyl ether), from Union Carbide, triethanol amine, Butyl Carbitol, from DuPont Co, Glyme (ethylene glycol dimethyl ether), Diglyme (diethylene glycol dimethyl ether).

There can also be used as organic carrier liquids the alkylene glycol monoalkyl ethers. The alkylene glycol mono alkyl ethers are low molecular weight amphiphilic compounds, particularly a mono-, di- or tri lower ($C_2$ to $C_3$) alkylene glycol mono lower ($C_1$ to $C_5$) alkyl ether. Suitable examples of such additive amphiphilic compounds are ethylene glycol monoethyl ether ($C_2H_5$—O—($CH_2CH_2OH$), diethylene glycol monobutyl ether ($C_4H_9$—O—$(CH_2CH_2O)_2H$) and dipropylene glycol monomethyl ether $$(CH_3{-}O{-}(CH_2\underset{\underset{CH_3}{|}}{C}HO)_2H).$$

The above discussed organic carrier liquids can be used alone or in admixture in order to obtain a desired viscosity and stability of the product liquid.

The compositions of the present invention have good viscosity and stability characteristics and remain stable and pourable at low temperatures.

SURFACTANT DETERGENTS

Nonionic Surfactant Detergents

The liquid nonionic surfactant detergents that can be used in the practice of the present are preferably the low foam surfactants.

A preferred class of the nonionic detergent employed is the poly-lower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mol. Exemplary of such compounds are those wherein the alkanol is of 12 to 15 carbon atoms and which contain about 7 ethylene oxide groups per mol.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include a $C_{13}$–$C_{15}$ fatty alcohol condensed with 6 moles ethylene oxide and 3 moles propylene oxide, a $C_{13}$–$C_{15}$ fatty alcohol condensed with 7 moles propylene oxide and 4 moles ethylene oxide and a $C_{13}$–$C_{15}$ fatty alcohol condensed with 5 moles propylene oxide and 10 moles ethylene oxide.

Other useful surfactants are Neodol 25-7 and Neodol 25-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

A preferred nonionic surfactant is available from Union Carbide Corporation under the trademark Tergitol MDS-42. This nonionic surfactant is a $C_{12}$–$C_{14}$ linear alcohol containing 55% by weight random distributed oxyalkyl groups of which 42% are ethoxy and 58% propoxy groups. Another nonionic surfactant that can be used is Alfonic 18-57.

Other useful nonionic surfactants are the Poly-Tergent S-LF surfactants available from Olin Corporation. These surfactants are low foaming, biodegradable alkoxylated linear fatty alcohols. Surfactants of this type are available under the tradenames Poly-Tergent S-LF 18, Poly-Tergent S-305-LF, Poly-Tergent S-405-LF and Poly-Tergent CS-1.

The use of the low foam nonionic surfactant, in the formulations is important in avoiding cavitation problems during the wash cycle. The use of the low foam nonionics is accordingly preferred.

Mixtures of two or more of the liquid surfactants can be used and in some cases advantages can be obtained by the use of such mixtures.

The detergent active materials used herein are selected to be stable in the presence of the other ingredients of the composition. In addition to the above discussed nonionic surfactants, anionic surfactants can also be used.

Anionic Surfactants

The anionic surfactants that can be used are the linear or branched alkali metal mono- and/or di-($C_{8-14}$) alkyl diphenyl oxide mono and/or disulphonates, commercially available for example as DOWFAX (Registered Trademark) 3B-2 and DOWFAX 2A-1.

Other suitable surfactants include the primary alkylsulphates, alkylsulphonates, alkylaryl-sulphates and sec. alkylsulphates. Examples include sodium $C_{10-18}$ alkylsulphates such as sodium dodecylsulphate and sodium tallow alcoholsulphate; sodium $C_{10-18}$ alkanesulphonates such as sodium hexadecyl-1-sulphonate and sodium $C_{12-18}$ alkylbenzenesulphonates such as sodium dodecylbenzenesulphonates. The corresponding potassium salts may also be employed.

The nonionic and anionic surfactants are used in amounts of 0.5 to 12%, for example about 1.0 to 10%, preferably about 1.0 to 7.0%.

Chlorine Bleach Compounds

Hypochlorite generating compounds suitable for use in the compositions of the present invention are those water soluble dry solid materials which generate hypochlorite ion on contact with, or dissolution in, water. Examples thereof are the dry, particulate heterocyclic N-chlorimides such as trichlorocyanuric acid, dichlorocyanuric acid and salts thereof such as sodium dichlorocyanurate and potassium dichlorocyanurate. The corresponding dichloroisocyanuric and trichloroisocyanic acid salts can also be used. Other N-chloromides may be used such as N-chlorosuccinimide, N-chloromalonimide, N-chlorophthalimide and N-chloronaphthalimide. Additional suitable N-chloroimides are the hydantoins such as 1,3-dichloro-5,5-dimethylhydantion;
N-monochloro-C,C-dimethylhydantion;
methylene-bis (N-chloro-C,C-dimethylhydantoin);
1,3-dichloro-5-methyl-5-isobutylhydantoin;
1,3-dichloro-5-methyl-5-ethylhydantoin;
1,3-dichloro-5,5-diisobutylhydantoin;
1,3-dichloro-5-methyl-5-n-amylhydantoin;

and the like. Other useful hypochlorite-liberating agents are trichloromelamine and dry, particulate, water soluble anhydrous inorganic salts such as calcium and lithium hypochlorite. The hypochlorite liberating agent may, if desired, be a stable, solid complex or hydrate such as sodium p-toluene-sulfo-chloramine-trihydrate (choramine-T), sodium benzene-sulfo-chloramine-dihydrate, calcium hypochlorite tetrahydrate, or chlorinated trisodium phosphate containing 0.5 to 4% available chlorine produced by combining trisodium phosphate in its normal $Na_3PO_4{:}12H_2O$ form and an alkali metal hypochlorite (e.g., sodium hypochlorite).

In compositions in which the alkali and alkaline earth metal hypochlorites are used as the chlorine source, these compounds can be used'in the form of anhydrous dispersed solids in order to prevent deteriation of the nonionic surfactants in the composition.

The preferred sources of hypochlorite are dichloro- and trichloroisocyanurates and chloramine-T (p-Toluenesulfochloramine).

Typically the chlorine-liberating agents are employed in a proportion of about 1 to 18% by weight of the composition, and preferably about 1.0 to 15% and more preferably 2 to 12%. Desirably the proportion thereof employed will be such as to yield a product which contains from about 0.5% to about 10% available chlorine on a total weight basis, preferably 1 to 8.4% and more preferably 1 to 6.7% available chlorine.

The composition should contain sufficient chlorine bleach compound to provide about 0.5 to 10.0% by weight of available chlorine, as determined, for example, by acidification of the composition with sulfuric acid and iodometric titration with sodium thiosulfate monitored by a potentiometer. A composition containing about 0.9 to 18% by weight of sodium dichloroisocyanurate dihydrate contains or provides about 0.5 to 10% available chlorine. A composition containing about 1.6 to 10.72% by weight calcium hypochlorite contains about 1 to 6.7% by weight available chlorine. A composition containing about 1.8 to 12.0% by weight sodium dichloroisocyanurate dihydrate contains about 1 to 6.7% by weight of available chlorine and is especially preferred.

Bromide Compounds

The bromide source or compound used in the present invention can be a solid water soluble bromide which preferably is of substantially neutral or slightly alkaline nature, providing a ready source of bromide ions on dissolution in water. It is preferred to employ alkali metal bromides such as sodium bromide, sodium bromide dihydrate, lithium bromide, and potassium bromide, although alkaline earth metal bromides such as calcium bromide and magnesium bromide may be employed in those instances in which these water hardness-producing cations are not objectionable.

The bromide compound for example alkali metal bromides are used in amounts of 0.1 to 6 wt. %, preferably 0.2 to 4.0 wt. % and more preferably 0.3 to 3.0 wt. %.

Preferably the bromide is employed in an amount which is substantially less than the molar equivalent of available chlorine present in the product, e.g., the mole ratio of water soluble bromide to available chlorine is in the range of 0.04 to 0.12, preferably less than 0.10, for example 0.05 to 0.095, and typically 0.05 to 0.090.

A balanced detergent composition is obtained which contains a small effective amount of the bromide to react with the hypochlorite to form a sufficient amount of hypobromite to remove the starchy carbohydrate soil and to leave a sufficient amount of hypochlorite ion in the wash bath to remove the proteinaceous soil.

Thus, the weight percent available chlorine and the mole ratio of bromide ion to available chlorine ion are critical features of the present invention.

Builder Salts

Generally, liquid ADD effectiveness is directly related to (a) available chlorine levels; (b) alkalinity; (c) solubility in washing medium; and (d) foam inhibition. It is preferred that the pH of the aqueous wash bath after addition of the liquid ADD composition be at least about 9.5, more preferably from about 10.5 to 13.5 and most preferably at least about 11.5.

The amount of alkali metal silicate added and the amount of alkali metal TPP added can be used to obtain the desired alkalinity in the wash bath. The sodium carbonate can be added to act as a buffer to maintain the desired pH level. The sodium carbonate can be added in an amount of 0 to 25 wt. %, preferably 5 to 20 wt. % and typically about 5 to 15 wt. % of the detergent composition.

The compositions of the present invention can contain inorganic builder salts such as NaTPP or organic builder salts such as the alkali metal salts of polycarboxylic acids.

A preferred inorganic builder salt is an alkali metal polyphosphate such as sodium tripolyphosphate (TPP). In place of all or part of the alkali metal polyphosphate one or more other detergent builder salts can be used. Suitable other builder salts are alkali metal borates, phosphates and bicarbonates. Specific examples of such builders are sodium tetraborate, sodium pyrophosphate, potassium pyrophosphate, sodium bicarbonate, sodium hexametaphosphate, sodium sesquicarbonate, sodium mono and diorthophosphate, potassium bicarbonate and sodium or potassium ziolites.

The detergent builders, e.g. NaTPP may be employed in the nonaqueous liquid ADD composition in a range of 20 to 60%, preferably about 15 to 55 wt. %, and more preferably about 20 to 45 wt. %, and should preferably be free of heavy metal which tends to decompose or inactivate the chlorine bleach compounds. The NaTPP may be anhydrous or hydrated, including the stable hexahydrate with a degree of hydration of 6 corresponding to about 18% by weight of water or more.

The NaTPP may be replaced in whole or in part by organic builder salts. Since the compositions of this invention are generally highly concentrated, and, therefore, may be used at relatively low dosages, it is desirable to supplement any phosphate builder (such as sodium tripolyphosphate) with an auxiliary builder such as an alkali metal polycarboxylic acid. Suitable alkali metal polycarboxylic acids are alkali metal salts of citric and tartaric acid, e.g. monosodium and disodium citrate (anhydrous). The sodium salts of citric and tartaric acids are preferred.

Foam Inhibitors

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of NaTPP which has a water softening effect may aid in providing the desired degree of foam inhibition. However, it is generally preferred to include a chlorine bleach stable foam depressant or inhibitor. Particularly effective are the alkyl phosphonic acid esters of the formula

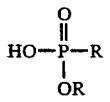

available, for example, from BASF-Wyandotte (PCUK-PAE), and especially the alkyl acid phosphate esters of the formula

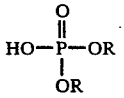

available, for example, from Hooker (SAP) and Knapsack (LPKN-158), in which one or both R groups in each type of ester may represent independently a $C_{12-20}$ alkyl group. Mixtures of the two types, or any other chlorine bleach stable types, or mixtures of mono- and di-esters of the same type, may be employed. Especially preferred is a mixture of mono- and di-$C_{16-18}$ alkyl acid phosphate esters such as monostearyl/distearyl acid phosphates 1.2/1 (Knapsack). When employed, proportions of 0.01 to 5 wt. %, preferably 0.1 to 5 wt. %, especially about 0.1 to 0.5 wt. %, of foam depressant in the composition is typical, the weight ratio of detergent active component to foam depressant generally ranging from about 10:1 to 1:1 and preferably about 4:1 to 1:1. Other defoamers which may be used include, for example, the known silicones such as Dow Corning 1400 and 1500, which are polysiloxanes mixed with dispersed silica.

The alkali metal silicates, e.g. sodium silicate, which provide alkalinity and protection of hard surfaces, such as fine china, are employed in an amount ranging from about 5 to 30 wt. %, preferably about 8 to 25 wt. %, and more preferably about 10 to 20 wt. %, in the composition. The sodium silicate also protects the washing machine from corrosion. The sodium silicate can have a $Na_2O:SiO_2$ ratio of 1.6/1 to 1/3.2. The sodium silicate can be added in the form of nonaqueous dispersions or dry powders, preferably having an $Na_2O:SiO_2$ ratio of from 1/1 to 1/2.8, for example, 1/1 to 1/2.4. Potassium silicates of the same ratios can also be used. The preferred alkali metal silicates are sodium disilicate and sodium metasilicate.

Most of the other components of the composition, for example, sodium hypochlorite and foam depressant can be added to the nonaqueous liquid composition in the form of dry powders or nonaqueous dispersions or solutions.

Various conventional ingredients may be included in these compositions in small amounts, generally less than about 4 wt. %, such as perfume, hydrotropic agents such as the sodium benzene, toluene, xylene and cumene sulphonates, preservatives, dyestuffs and pigments and the like, all of course being stable to chlorine bleach compound and high alkalinity (properties of many of the components). Especially preferred for coloring are the chlorinated phthalocyanines and polysulphides of aluminosilicate which provide, respectively, pleasing green and blue tints.

The composition may also include conventional organic or inorganic thickening agents in amounts sufficient to obtain a product consistency of a cream or a paste.

The thickening agents, i.e. thickeners or suspending agents which provide thickening properties, are known in the art and may be organic or inorganic, water soluble or insoluble, dispersible or colloid-forming, and monomeric or polymeric, and should of course be stable in these compositions, e.g. stable to alkalinity and bleach compounds, such as sodium hypochlorite. The preferred thickeners generally comprise the inorganic, colloid-forming clays of smectite and/or attapulgite types. These materials are generally used in amounts of about 1.5 to 10, preferably 2 to 5 wt %, to confer the desired thickening properties to the formulation.

Smectite clays include montmorillonite (bentonite), hectorite, attapulgite, smectite, saponite, and the like. Montmorillonite clays are preferred and are available under tradenames such as Thixogel (Registered Trademark) No. 1 and Gelwhite (Registered Trademark) GP, H, etc., from Georgia Kaolin Company; and ECCAGUM (Registered Trademark) GP, H, etc., from Georgia Kaolin Company; and ECCAGUM (Registered Trademark) GP, H, etc., from Luthern Clay Products. Attapulgite clays include the materials commercially available under the tradename Attagel (Registered Trademark), i.e. Attagel 40, Attagel 50 and Attagel 150 from Engelhard Minerals and Chemicals Corporation. Mixtures of smectite and attapulgite types in weight ratios of 4:1 to 1:5 are also useful. Thickening or suspending agents of the foregoing types are well known in the art, being described, for example, in U.S. Pat. No. 3,985,668, which is incorporated herein by reference thereto.

The conventionally used organic polymeric thickening agents, such as the polyacrylates, e.g. powdered polyacrylates having a molecular weight of 1,000–20,000 can be used. Suitable polyacrylates, e.g. sodium, are Alcosperse 130D, MW 15,000, available from Alco Chem. Co. Alcosperse 149D, MW 2000, available from Alco Chem. Co., and Alcrysol 45N, MW 4500, available from Rhom & Haas Co. The polyacrylates are disclosed more fully in copending application Ser. No. 323,126, filed Mar. 10, 1989, which is encorporated herein by reference thereto.

The nonaqueous liquid ADD compositions of this invention are readily employed in known manner for washing dishes, glasses, cups, cookware, eating utensils and the like in an automatic dishwasher, provided with a suitable detergent dispenser, in an aqueous wash bath containing an effective amount of the composition.

In a preferred embodiment of the invention an automatic dishwashing detergent concentrate composition is formulated using the below named ingredients.

| Component | Weight Percent |
|---|---|
| Organic Carrier Liquid | 30–45 |
| Surfactant Detergent | 3–7.0 |
| Sodium Tripolyphosphate | 20–45 |
| Sodium Carbonate | 5–15 |
| Sodium Silicate | 10–20 |
| Sodium Bromide | 1–3.0 |
| Sodium Dichloroisocyanurate (Available Chlorine) | 3–6.7 |
| Sodium Polyacrylate (MW 15,000) | 4–10 |
| Pigment | 0.5 to 2.5 |

The commercially available liquid detergent composition dose per wash is 80 grams, whereas the concentrate liquid detergent composition dose per wash of the present invention is 40 grams.

The nonaqueous liquid dishwasher detergent compositions of the present invention can contain conventional dishwashing detergent composition additives. The formulations can be prepared with commercially available powder detergent builders, chlorine bleach source compounds and bromide compounds.

The formulations can be prepared using the conventional blending and mixing procedures used for the preparation of liquid detergent compositions as briefly described below.

METHOD OF PREPARATION OF LIQUID COMPOSITION

The compositions of the present invention can be prepared in two stages. In the first stage powdered silicate and low molecular weight polyacrylate powder are premilled using a ceramic ball mill. The premilled materials are then mixed using a standard rotary mixer. This mixed material is then transferred to an attritor and milled for 30 minutes at 500 rpm using ¼ inch stealite grinding media.

In the second stage Butylcarbitol (organic carrier liquid) and Neodol 25-6.5 (nonionic surfactant) are mixed, and the defoamer and phosphate builder salts are added. The premilled silicate and polyacrylate are then added to the Butylcarbitol and nonionic surfactant mixture followed by the addition of sodium carbonate, chlorine bleach, bromide and the remaining ingredients. After mixing the liquids solids mixture is vigorously stirred to obtain a stable dispersion of the solids in the organic carrier liquid.

One or more of the ingredients can be omitted or additional ingredients such as perfumes and anti-foam agents can be added to the composition.

The term nonaqueous liquid compositions as used herein is intended to include compositions containing 0–15% water, typically 2–12% and more typically 4–8% water. The water can be present in the form of hydrated compounds, i.e. bound water, for example, sodium tripolyphosphate hexahydrate, hydrated sodium carbonate, hydrated sodium sulfate and dichloroisocyanurate dihydrate and/or in the form of moisture, i.e. unbound water. It is preferred, however, that the composition contain less than 1% moisture as unbound water.

In the compositions containing an alkali metal hypochlorite and a nonionic surfactant, it is particularly important that the compositions contain less than 1% unbound water, or substantially 0% unbound water, inorder to prevent deterioration of the nonionic surfactant.

The invention may be put into practice in various ways and a number of specific embodiments will be described to illustrate the invention with reference to the accompanying examples.

All amounts and proportions referred to herein are percent by weight of the composition unless otherwise indicated.

The present invention is further illustrated by the following examples.

EXAMPLE 1

In accordance with the present invention nonaqueous liquid automatic dishwasher detergent compositions are formulated using the below, named ingredients in the amounts indicated.

| Ingredient | Concentrated Composition Wt. % | Comparison Composition Wt. % |
|---|---|---|
| Organic Carrier Liquid(1) | 31.14 | 34.94 |
| Surfactant(2) | 6.0 | 6.0 |
| Sodium Tripolyphosphate (Anhydrous) | 23.0 | 26.0 |
| Sodium Meta-Silicate | 14.5 | 14.5 |
| Sodium Acrylate(3) | 6.0 | — |
| Sodium Carbonate | 12.0 | 12.0 |
| Sodium Dichloroisocyanurate(4) | 5.36 | 5.36 |

-continued

| Ingredient | Concentrated Composition Wt. % | Comparison Composition Wt. % |
|---|---|---|
| Sodium Bromide | 0.80 | — |
| Dow 1500 Antifoam[5] | 1.2 | 1.2 |
| | 100 | 100 |

[1]Methoxypolyethylene Glycol, Carbowax MPEG 350, Union Carbide.
[2]Tergital MDS-42, from Union Carbide, which is a nonionic surfactant and is a $C_{12}$—$C_{14}$ linear alcohol containing 55% by weight random distributed oxyalkyl groups of which 42% are ethoxy and 58% propoxy groups.
[3]Alcosperse 130 D, MW 15,000.
[4]ACl 56, from Monsanto Corporation, available chlorine in composition is 3.0% by weight.
[5]Mixture of silica powder and dimethyl polysiloxan.

The mole ratio of bromide to available chlorine in the above invention composition is about 0.09.

Multi-soil cleaning tests are run at stress conditions of 120° F. wash cycle temperature and 300 ppm hard water in a low performance dishwasher. This is done to show differences between the products which are less apparent in normal use conditions with tap water, e.g. 100 ppm hard water, and 140° F. wash temperature.

Egg soil is prepared by mixing egg yolk with an equal amount of 2.5N calcium chloride solution. 0.4 grams of this mixture is applied to the usable surface of 7.5 inch china plates in a thin film. The plates are aged in 50% relative humidity overnight.

Oatmeal soil is prepared by boiling 24 grams of Quaker Oates in 400 ml of tap water for ten minutes. 3 grams of this mixture is spread onto a 7.5 inch china plate. The plates are aged for 2 hours at 80° C. They are then stored overnight at room temperature. Two plates are used per wash.

The plates are always placed in the same position in the dishwasher.

The nonaqueous liquid detergent products to be tested are added at the beginning of the wash cycle. 40 gm of product is used for each test. All plates are scored by measuring the percent area cleaned.

The multi-soil cleaning results are reported below:

| Product | Percent Soil Removal | |
|---|---|---|
| | Egg | Starch |
| Invention Composition | 50% | 90% |
| Comparison Composition | 45% | 40% |

The above compositions are also tested cleaning glass tumblers.

The ASTM Method D3556-79 for the deposition on glassware during mechanical dishwashing is used to evaluate the buildup of spots and film on glassware. 40 gm of comparison liquid ADD and 40 gm of the invention liquid detergent is used in each test. All testing reported is done in Kenmore Model 587.1548580 and/or model 587.1546580 Automatic Dishwasher. The water wash temperature is 120° F. and the water has 300 ppm hardness and the results are the average of four washes using 6 to 10 glass tumblers per wash.

The information obtained is reported below.

| | Spot | Film |
|---|---|---|
| Invention Composition | 1 | 1.5 |
| Comparison Composition | 1.3 | 2.5 |

The film/spot scale used in the above evaluation is given below.

SPOT/FILM SCALE

| |
|---|
| Spot On Glasses |
| 1 = no spots |
| 2 = 1-2 spots |
| 3 = 25 percent of glass covered with spots |
| 4 = 50 percent of glass covered with spots |
| 5 = 100 percent of glass covered with spots |
| Film On Glasses |
| 1 = best - no film |
| 2 = film slightly apparent |
| 3 = increase in noticeable film |
| 4 = filming significant |
| 5 = filming becoming excessive |
| 6 = filming highly excessive |

EXAMPLE 2

Following the teachings of the invention a nonaqueous liquid automatic dishwasher detergent composition is formulated using the below named ingredients in the amounts indicated.

| | Weight Percent |
|---|---|
| Organic Carrier Liquid[1] | 32-38 |
| Sodium Tripolyphosphate[2] | 23.4 |
| Nonionic Surfactant[3] | 3.0 |
| Sodium Carbonate | 12 |
| Sodium Silicate | 14.0 |
| Sodium Acrylate[4] | 6.0 |
| Sodium Bromide[5] | 0-6 |
| Sodium Dichloroisocyanurate[6] | 3.6 |

[1]Butylcarbitol.
[2]STPP (anhydrous).
[3]Tergitol MDS-42.
[4]Alcosperse 130 D, MW 15,000.
[5]Sodium bromide concentration is varied from 0 (control) to 6.0 wt. % for comparison purposes. The organic carrier liquid is adjusted to 100%. There are four formulations prepared containing 0 (control), 0.6, 1.0 and 2.0 wt. % sodium bromide.
[6]Available chlorine in composition is 2.0% by weight.

The formulations and soiled dishware are prepared following the procedure of Example 1 except that porridge is substituted for the oatmeal. 40 gm of product is used for each test. The multi-soil cleaning test is carried out following the procedure of Example 1, but using GE Model GSD 1200G Automatic Dishwasher at 120° F. wash temperature and tap water with about 110 ppm water hardness.

The results that are obtained are reported in the below table.

| Test | ADD Formulation Sodium Bromide Concentration Weight % | Percent Porridge Removal | Percent Egg Removal | Mole Ratio Bromide To Available Chlorine |
|---|---|---|---|---|
| A | 0 | 20 | 90 | — |
| B | 0.6 | 80 | 75 | 0.10 |

-continued

| Test | ADD Formulation Sodium Bromide Concentration Weight % | Percent Porridge Removal | Percent Egg Removal | Mole Ratio Bromide To Available Chlorine |
|---|---|---|---|---|
| C | 1.0 | 100 | 60 | 0.17 |
| D | 2.0 | 100 | 30 | 0.34 |

The above information illustrates the effect on the removal of proteineous soil and starch carbohydrate soil by varying the mole ratio of bromide to available chlorine in the formulation.

EXAMPLE 3

In accordance with the present invention a nonaqueous liquid automatic dishwasher detergent composition is formulated using the below named ingredients in the amounts indicated.

| Component | Weight Percent |
|---|---|
| Organic Carrier Liquid | 40.2 |
| Nonionic Surfactant | 3.0 |
| Sodium Tripolyphosphate | 30.0 |
| Sodium Carbonate | 8.0 |
| Sodium Silicate (1:1) | 14.0 |
| Sodium Bromide | 0.30 |
| Sodium Dichloroisocyanurate(1) | 2.5 |
| Clay Thickening Agent | 2.0 |
| | 100.0 |

(1)1.4% by weight available chlorine.

The mole ratio of bromide to available chlorine is 0.07.

About 60 gm of the above formulation is used in an automatic dishwasher machine to clean dishes containing baked on proteinaceous egg soil and baked on starchy carbohydrate pasta soil.

The dishes after a normal wash cycle are removed from the dishwasher and are found to be substantially reduced in both the proteinaceous egg soil and the starchy carbohydrate pasta soil.

EXAMPLE 4

Following the teachings of the present invention a nonaqueous liquid automatic dishwasher detergent composition is formulated using the below named ingredients in the amounts indicated.

| Ingredient | Weight Percent |
|---|---|
| Organic Carrier Liquid | 36.4 |
| Nonionic Surfactant | 4.0 |
| Sodium Tripolyphosphate | 15.0 |
| Sodium Citrate | 15.0 |
| Sodium Carbonate | 8.0 |
| Sodium Silicate (1:2.4) | 16 |
| Sodium Bromide | 0.60 |
| Sodium Dichloroisocyanurate(1) | 5.0 |
| | 100.0 |

(1)2.8% by weight available chlorine.

The mole ratio of bromide to available chlorine is 0.07.

About 60 gm of the above concentrated liquid formulation is used in an automatic dishwasher machine to clean dishes containing baked on proteinaceous egg soil and baked on starchy carbohydrate pasta soil.

The dishes after a normal wash cycle are removed from the dishwasher and are found to be substantially reduced in both the proteinaceous egg soil and the starchy carbohydrate pasta soil.

The above illustrative Examples show that the dual bleach automatic dishwashing powder detergent compositions of the present invention provide improved removal of proteinaceous soils and starchy carbohydrate soils from dishware, glassware and the like.

The invention is not to be limited by the above disclosure and examples which are given as illustrations only. The invention is to be interpreted in accordance with the below claims.

What is claimed is:

1. A liquid dishwashing detergent composition having improved cleaning performance against both proteinaceous and carbohydrate soils comprising approximately by weight (a) 30 to 60% of a nonaqueous organic carrier liquid selected from the group consisting of mono $C_2$ to $C_3$ alkylene glycol mono $C_1$ to $C_5$alkyl ethers, di $C_2$ to $C_3$ alkylene glycol mono $C_1$ to $C_5$ alkyl ethers, tri $C_2$ to $C_3$ alkylene glycol mono $C_1$ to $C_5$ alkyl ethers, ethylene glycol dimethyl ether, diethylene glycol dimethyl ether, polyethylene glycol methyl ether, butyl carbitol, triethanol amine, propylene glycol, propylene carbonate, polypropylene glycol and methoxy propylene glycol and mixtures thereof; (b) about 1.0 to 10.0% of a chlorine bleach stable, water dispersible organic surfactant detergent active material; (c) at least one ingredient selected from the group consisting of 20 to 60% detergent builders, 0.01 to 5% foam inhibitors and mixtures thereof; and (d) a dual bleach system comprising a hypochlorite generating compound in an amount to provide about 0.5 to 10% of available chlorine and a water soluble bromide compound wherein the mole ratio of said water soluble bromide compound to available chlorine is 0.04 to 0.12 and said composition contains less than 1% unbound water.

2. The composition of claim 1 wherein the hypochlorite generating compound contains 0.5 to 10 wt. % available chloride and the water soluble bromide compound is in an amount of 0.1 to 6.0%.

3. The composition of claim 2 wherein the hypochlorite generating compound is selected from the group consisting of chlorocyanurates, chloroisocyanurates, dichloroisocyanurates, and alkali and alkaline earth metal hypochlorites.

4. The composition of claim 2 wherein the water soluble bromide compound is selected from the group consisting of alkali and alkaline earth metal bromides.

5. The composition of claim 2 wherein the hypochlorite generating compound is sodium dichloroisocyanurate or sodium trichloroisocyanurate or mixtures thereof.

6. A method for cleaning soiled dishware which contain both proteinaceous soils and carbohydrate soils which comprises contacting the soiled dishware in an aqueous wash bath having dispersed therein an effective amount of the composition of claim 2 to obtain clean dishware reduced in protainaceous soils and carbohydrate soils.

7. A method for cleaning soiled dishware which contain proteinaceous soils and carbohydrate soils which comprises the soiled dishware in an aqueous wash bath having dispersed therein an effective amount of the composition of claim 1.

8. The method of claim 7 wherein the chlorine bleach compound in the composition is a member selected from the group of chlorocyanurates, chloroisocyanurates, dichloroisocyanurates, alkali and alkaline earth hypochlorites.

9. The method of claim 7 wherein the bromide compound in the composition is a member selected from the alkali and alkaline earth metal bromides.

10. A liquid dishwasher composition comprising approximately by weight:

(a) 30 to 60% of a non aqueous organic carrier liquid selected from the group consisting of mono $C_2$ to $C_3$ alkylene glycol mono $C_1$ to $C_5$ alkyl ethers, di $C_2$ to $C_3$ alkylene glycol mono $C_1$ to $C_5$ alkyl ethers, tri $C_2$ to $C_3$ alkylene glycol mono $C_1$ to $C_5$ alkyl ethers, ethylene glycol dimethyl ether, diethylene glycol dimethyl ether, polyethylene glycol methyl ether, butyl carbitol, triethanol amine, propylene glycol, propylene carbonate, polypropylene glycol and methoxy propylene glycol and mixtures thereof;

(b) 0.1 to 10% of a chlorine bleach stable, water-dispersible organic detergent active material;

(c) 20 to 60% inorganic or organic detergent builder selected from the group consisting of alkali metal polyphosphates, alkali metal borates, alkali metal phosphates, alkali metal bicarbonates and alkali metal polycarboxylic acids;

(d) 5 to 30% sodium silicate;

(e) 0 to 6% chlorine bleach stable foam depressant;

(f) chlorine bleach compound capable of forming hypochlorite on addition to water in an amount to provide about 0.5 to 10% of available chlorine; and (g) a sufficient amount of a water soluble bromide compound to provide a mole ratio of water soluble bromide compound to available chlorine of 0.056 to 0.09, said composition containing less than 1% unbound water.

11. The composition of claim 10 wherein the water soluble bromide compound is an alkali metal or alkaline earth metal bromide.

12. The composition of claim 10 wherein the water soluble bromide compound is sodium bromide.

13. The composition of claim 10 wherein the hypochlorite generating compound is calcium hypochlorite or lithium hypochlorite.

14. The composition of claim 10 wherein the hypochlorite generating compound is in an amount of 1 to 15 wt. %.

15. The composition of claim 10 wherein the water soluble bromide compound is in an amount of 0.20 to 4.0 wt. %.

16. A method for cleaning soiled dishware which contain both proteinaceous soils and carbohydrate soils which comprises contacting the soiled dishware in an automatic dishwashing machine in an aqueous wash bath having dispersed therein an effective amount of the composition of claim 10.

17. The method of claim 16 wherein the hypochlorite source in the composition contains 0.5 to 10 wt. % available chlorine, the bromide compound is in an amount of 0.1 to 6.0%.

18. The method of claim 16 wherein the bromide compound in the composition is an alkali metal or alkaline earth metal bromide.

19. The method of claim 16 wherein the bromide compound in the composition is sodium bromide.

20. The method of claim 16 wherein the chlorine compound in the composition is calcium hypochlorite or lithium hypochlorite.

21. The method of claim 16 wherein the chlorine compound in the composition is in an amount of 1 to 15 wt. %.

22. The method of claim 16 wherein the bromide compound in the composition is in an amount of 0.20 to 4.0 wt. %.

23. A liquid automatic dishwasher detergent composition comprising approximately by weight:

(a) 30 to 50% of a carrier liquid selected from the group consisting of mono $C_2$ to $C_3$ alkylene glycol mono $C_1$ to $C_5$ alkyl ethers, di $C_2$ to $C_3$ alkylene glycol mono $C_1$ to $C_5$ alkyl ethers, tri $C_2$ to $C_3$ alkylene glycol mono $C_1$ to $C_5$ alkyl ethers, ethylene glycol dimethyl ether, diethylene glycol dimethyl ether, polyethylene glycol methyl ether, butyl carbitol, triethanol amine, propylene glycol, propylene carbonate, polypropylene glycol and methoxy propylene glycol and mixtures thereof;

(b) 1.0 to 10.0% of a chlorine bleach stable, water dispersible organic surfactant detergent active material;

(c) 15 to 55% alkali metal tripolyphosphate builder;

(d) 8 to 25% sodium silicate;

(e) 5 to 20% alkali metal carbonate;

(f) 0.1 to 4% chlorine bleach stable foam depressant;

(g) chlorine bleach compound selected from the group of chlorocyanurates, chloroisocyanurates, alkali and alkaline earth metal hypochlorites in an amount to provide about 1 to 8.4% of available chlorine: and (h) a sufficient amount of water soluble bromide compound to provide a mole ratio of water soluble bromide to available chlorine of 0.05 to 0.095, said composition containing less than 1% unbound water.

24. A method of preparing a liquid dishwashing detergent composition having improved cleaning performance against both proteinaceous and carbohydrate soils which composition comprises approximately by weight:

(a) 30 to 60% of an organic carrier liquid selected from the group consisting of mono $C_2$ to $C_3$ alkylene glycol mono $C_1$ to $C_5$ alkyl ethers, di $C_2$ to $C_3$ alkylene glycol mono $C_1$ to $C_5$ alkyl ethers, tri $C_2$ to $C_3$ alkylene glycol mono $C_1$ to $C_5$ alkyl ethers, ethylene glycol dimethyl ether, diethylene glycol dimethyl ether, polyethylene glycol methyl ether, butyl carbitol, triethanol amine, propylene glycol, propylene carbonate, polypropylene glycol and methoxy propylene glycol and mixtures thereof;

(b) 0.1 to 12% of a chlorine bleach stable, water dispersible organic surfactant detergent active material;

(c) 20 to 60% inorganic or organic detergent builder selected from the group consisting of alkali metal polyphosphates, alkali metal borates, alkali metal phosphates, alkali metal bicarbonates and alkali metal polycarboxylic acids;

(d) 5 to 30% sodium silicate;

(e) 0 to 6% chlorine bleach stable foam depressant;

(f) chlorine bleach compound capable of forming hypochlorite on addition to water in an amount to provide about 0.5 to 10% of available chlorine; and (g) a sufficient amount of water soluble bromide compound to provide a mole ratio of water soluble bromide to available chlorine of 0.05 to 0.09, said method comprising premilling in a first stage said sodium silicate; mixing in a second stage the organic carrier liquid and the organic detergent material and then adding the detergent builder to the second stage, adding the premilled silicate from the first stage to the mixed organic carrier liquid and the organic detergent material in the second stage, adding to the mixture in the second stage the chlorine bleach compound, bromide compound and the remaining ingredients, mixing the ingredients in the second stage, and vigorously stirring the mixture to obtain a stable dispersion of the ingredients in the organic carrier liquid.

25. The method of claim 24 wherein the mole ratio of bromide compound to available chlorine is 0.05 to 0.095.

* * * * *